US007737849B2

(12) United States Patent
Hwang et al.

(10) Patent No.: US 7,737,849 B2
(45) Date of Patent: Jun. 15, 2010

(54) SWITCH DETECTION DEVICE USING RFID TAG

(75) Inventors: Chi-Kuang Hwang, Hsin Chu (TW); Chih-Hu Wang, Hsin Chu (TW); Ching-Cheng Tien, Hsin Chu (TW); In-Hang Chung, Hsin Chu (TW); Bore-Kuen Lee, Hsin Chu (TW); Tung-Chou Chen, Hsin Chu (TW); Chia-Wen Wu, Hsin Chu (TW); Chien-Jung Chiu, Hsin Chu (TW); Ming-Ching Yen, Hsin Chu (TW); Jwu-E Chen, Hsin Chu (TW)

(73) Assignee: Chung Hua University, Hsin Chu (TW)

( * ) Notice: Subject to any disclaimer, the term of this patent is extended or adjusted under 35 U.S.C. 154(b) by 459 days.

(21) Appl. No.: 11/727,569

(22) Filed: Mar. 27, 2007

(65) Prior Publication Data

US 2008/0007408 A1 Jan. 10, 2008

(30) Foreign Application Priority Data

Jul. 7, 2006 (TW) ..... 95124979 A
Jul. 7, 2006 (TW) ..... 95124984 A

(51) Int. Cl.
*G08B 13/14* (2006.01)

(52) U.S. Cl. ..... 340/572.1; 340/10.1; 340/554; 340/545.7; 340/545.8

(58) Field of Classification Search ..... 340/572.1, 340/10.1, 505, 541, 554.1, 549, 545.6, 545.7, 340/545.8

See application file for complete search history.

(56) References Cited

U.S. PATENT DOCUMENTS

| | | | | |
|---|---|---|---|---|
| 6,025,783 | A * | 2/2000 | Steffens, Jr. | 340/644 |
| 6,583,722 | B2 * | 6/2003 | Jeutter et al. | 340/573.1 |
| 6,700,310 | B2 * | 3/2004 | Maue et al. | 310/339 |
| 6,828,902 | B2 * | 12/2004 | Casden | 340/10.3 |
| 7,321,306 | B2 * | 1/2008 | Lee et al. | 340/572.1 |
| 7,348,875 | B2 * | 3/2008 | Hughes et al. | 340/10.4 |
| 7,466,041 | B2 * | 12/2008 | Urman | 307/139 |
| 7,489,247 | B2 * | 2/2009 | Lee et al. | 340/572.1 |
| 2002/0008632 | A1 * | 1/2002 | Clothier | 340/825.37 |
| 2008/0186173 | A1 * | 8/2008 | Gates | 340/542 |

* cited by examiner

*Primary Examiner*—Travis R Hunnings
(74) *Attorney, Agent, or Firm*—Rosenberg, Klein & Lee

(57) ABSTRACT

A switch detection device using RFID tags is disclosed. The switch detection device includes a RFID tag, a conducting circuit loop and a switch connected to the conducting circuit loop to form a control circuit. The switch is controlled to turn on or off, leading to the closing or opening of the control circuit. The RFID tag detects the state of the conducting circuit loop and transmits a signal representing the opened/closed state to a RFID reader. The switch detection device is incorporated to a turning operation mechanism which includes a lever lock assembly, a deadbolt lock assembly, a window sash lock assembly, an odometer wheel, a hinge provided with a first hinge member and a second hinge member interconnected by a central axle, a door closer, a water faucet, a rotatable switch, or a rotatable lock.

18 Claims, 12 Drawing Sheets

SWITCH DETECTION DEVICE USING RFID TAG

FIELD OF THE INVENTION

The present invention relates to a switch detection device, and in particular to a switch detection device using Radio Frequency Identification (RFID) tag. The switch detection device using RFID tag transmits the product information stored in the RFID tag and can be used to control or monitor the ON/OFF of a switch like a water faucet.

BACKGROUND OF THE INVENTION

Barcode reader is widely used in the industry for reading a message on a barcode adhered on an object. However, in operation, errors are frequently found, especially when the barcode reader is not closed enough to the barcode for detection. Moreover, it is required to project light on the barcode for the barcode reader to read.

Recently, it is found that radio frequency identification (RFID) techniques have been applied to many applications for easily obtaining messages on an object. The message is stored in a RFID tag and a signal is transmitted wirelessly from the RFID tag to a RFID reader within an effective transmission distance. A large amount of messages can be transmitted by radio frequency identification. It is very simple and convenient to read a message by RFID.

Passive RFID transponders or tags, instead of the conventional barcode tags, are used to communicate messages for product tracking. The use of passive RFID tags includes the mounting of the RFID tags in the packaging of wine bottles and corks in which the RFID tags carry anti-counterfeit and product-tracking information. Once the cork of a wine bottle is removed, the RFID tag mounted thereof is destroyed simultaneously; hence a RFID reader receives no signals from the destroyed RFID tag. It is also easy for the RFID reader to identify a counterfeit wine that would not send messages to the RFID reader. Hence, any opened wine or counterfeit wine is recognized and prevented. However, it is noted that once the RFID tag is destroyed, whether it is destroyed intentionally by the consumer or unintentionally by the manufacturing machine or workers, the RFID reader is not able to read any information from the RFID tag, and hence not able to track the product.

U.S. Pat. No. 6,486,780 discloses applications for radio frequency identification systems. RFID devices, including handheld RFID devices, and applications may be used in connections with items that are associated with an RFID tag, and optionally a magnetic security element. The devices and applications can be applied for management of books and materials in a library.

A multi-directional RFID antenna is disclosed in U.S. Pat. No. 6,069,564. The antenna provides multi-directional RF communication to a source, such as a RF tag, which comprises a plurality of coils for transmission of RF signals and a switch for selecting at least one of the RF antenna coils for transmission of the RF signal and receipt of the RF response signals whereby the RF signals can be directed toward and received from a plurality of different directions from a fixed position.

In WO 2006/049374A1, a RFID sensor is disclosed. The RFID sensor comprises a plurality of RFID chips for monitoring different objects e.g. gas valve, door, window and so on. The RFID reader transmits a radio frequency signal to the RFID sensor at a predetermined period, and receives a frequency signal having the unique number of the chosen RFID chip from the RFID sensor. Then the RFID reader transmits the signal to the controller to recognize the used state of the monitored object. The controller can provide the information, e.g. "the gas valve is open", to the user through a Personal Digital Assistance. The system also comprises a selection unit for choosing the chip by a physical or an electrical operation and connecting the chosen chip to the RFID antenna. Therefore, the accessing of information from the chips is controlled to assure safety. The system requires a plurality of RFID tags that increase the manufacture cost. Moreover, the system is unable to realize whether the RFID tags that are connected to the antenna work normally or not.

Taiwan Patent No. 494245 discloses a radio frequency identification tag device having a sensor input adapted to receive variable signals from a sensor which may be a switch, a transistor, a hall effect device, a photo-transistor and the like. The difference between the two data word bit streams represent the change in the sensor (open or closed) which represents whatever the sensor represents, i.e., open or closed valve, circuit breaker on or tripped, and the like. The sensor input modifies the tag data word bit stream. In the patent, a register is arranged in the logic circuit for reading and/or writing information.

The conventional security systems for detecting the ON/OFF status of a switch mainly adopt wired configuration. It is desired to provide a detection device that is able to detect the status of a switch, control or monitor the ON/OFF of a switch wirelessly that is simple for installation and is cheap in manufacturing cost.

SUMMARY OF THE INVENTION

Thus, the primary object of the present invention, therefore, is to provide a detection circuit comprising a conducting circuit, a switch and a RFID tag. When the switch is turned on/off, a signal representing the opened/closed state of the detection circuit is transmitted by the RFID tag to a nearby RFID reader. No register is required for storing of detected signal.

Another object of the present invention, therefore, is to provide a switch detection device using RFID tags. The switch detection device adopts wireless design, that the ON/OFF status of a switch is transmitted wirelessly by the RFID tag to a nearby RFID reader. The switch detection device may be incorporated to a security system for controlling or monitoring the ON/OFF status of a switch.

A further object of the present invention, therefore, is to provide a switch operation detection using RFID tags. The switch operation detection comprises a switch which is driven to turn on either by mechanical force or magnetic induction. This connection or disconnection of the switch respectively leads to the closing or opening of the conducting circuit loop. A signal, representing the state of the conducting circuit loop, is transmitted by the RFID tag to a nearby RFID reader. The operation of the switch would not damage the RFID tag, that enables the RFID tag to provide product information.

Yet a further object of the present invention is to provide a switch operation detection comprising a conductive circuit loop and a wired external switching loop. A switch is used, which is turned on/off by mechanical force or magnetic induction. The operation of the switch causes the connection/disconnection of the conductive circuit loop and the wired external switching loop simultaneously. A signal indicating the state of the conductive circuit loop is transmitted by RFID tag to a nearby RFID reader, while a signal indicating the state of the wired external switching loop is transmitted wirely through two terminals.

Yet a further object of the present invention is to provide a switch detection device incorporated with a turning operation mechanism, the detection circuit being arranged to detect a rotation operation of the turning operation mechanism.

To fulfill the above objects, the present invention provides a switch operation detection using RFID tag. The switch detection device comprises a RFID tag, a conducting circuit loop and at least one switch connected to the conducting circuit loop. The switch is controlled to turn on or off, leading to the closing or opening of the control circuit. The RFID tag detects the state of the conducting circuit loop and transmits a signal representing the opened/closed state to a nearby RFID reader.

The switch detection device can be incorporated to any systems for detecting the status of a device, e.g. a monitoring system or a security system. Though the switch detection device, the monitoring system detects the operation status of a device, e.g. the opening of a water faucet, the water usage of a water flow meter and so on. The detection of the switch detection device also enables a security system to monitor e.g. the opening of a door or a window. The switch detection device also enables the remote control of a switch.

The switch detection device can be incorporated to a turning operation mechanism which includes a lever lock assembly, a deadbolt lock assembly, a window sash lock assembly, an odometer wheel, a hinge provided with a first hinge member and a second hinge member interconnected by a central axle, a door closer, a water faucet, a rotatable switch, or a rotatable lock.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
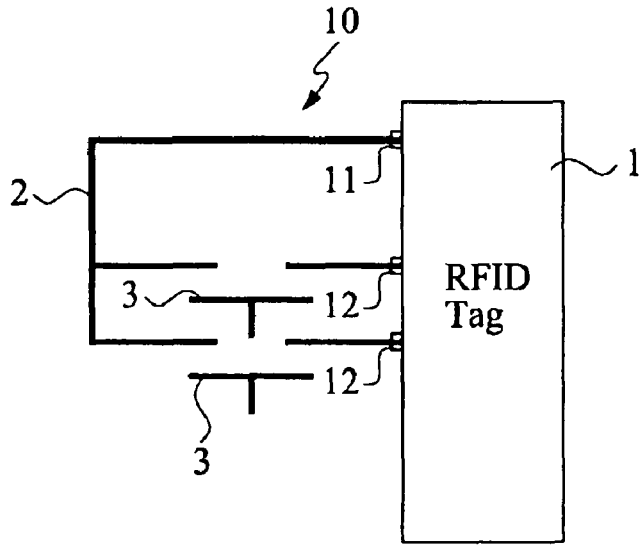
FIG. 1 is a detection circuit of a switch detection device with a RFID tag in accordance with the present invention.
Figure 2:
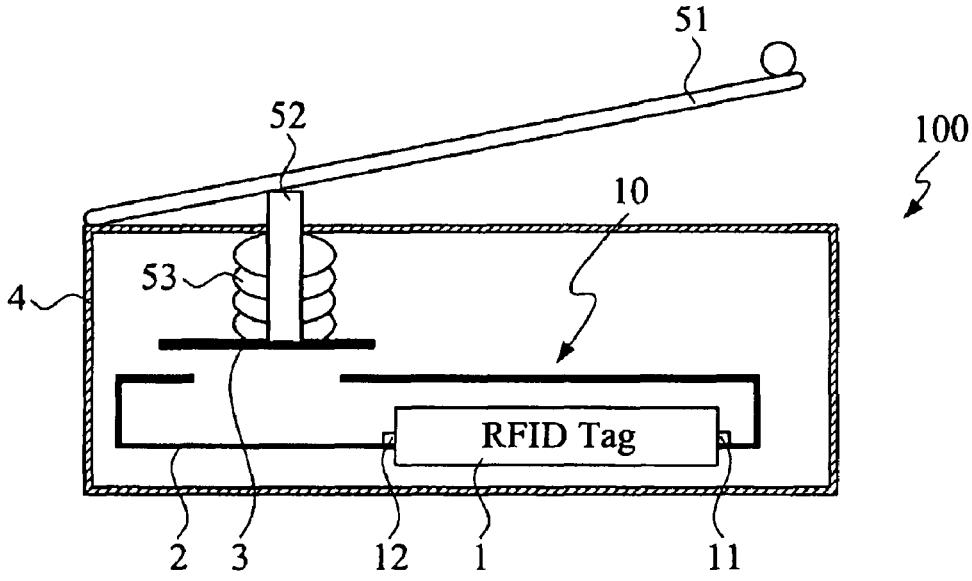
FIG. 2 is a schematic view of a switch detection device in accordance with a first embodiment of the present invention.

With reference to the drawings and in particular to FIGS. 1 and 2, FIG. 1 is a detection circuit of a switch detection device with a RFID tag in accordance with the present invention, and FIG. 2 is a schematic view of a switch detection device in accordance with a first embodiment of the present invention. The detection circuit of the switch detection device is generally designated with reference numeral 10, which comprises a RFID tag 1. The RFID tag 1 includes a reference voltage port 11 and a plurality of data input/output ports 12. The reference voltage port 11 is connected to a first end of a conducting circuit loop 2. The conducting circuit loop 2 is provided with, for example two second ends which are connected to the data input/output ports 12 respectively through a switch 3 capable of controlling the opening or closing of the conducting circuit loop 2.

In practice, the data input/output ports 12 may be designed in either a pull high or a pull low voltage port. If the data input/output port 12 adopts the pull high design, the reference voltage port 11 should be connected to a ground with a low level voltage source. If the data input/output port 12 adopts the pull low design, the reference voltage port 11 should be connected to a positive voltage source.

When the data input/output port 12 adopts the pull high design and the switch 3 is driven to open, the conducting circuit loop 2 between the reference voltage port 11 and the data input/output port 12 is changed from a closed state to an open state. Hence, the potential of the data input/output port 12 changes from low to high voltage level.

On the contrary, if the data input/output port 12 adopts the pull low design and the switch 3 is driven to closed, the conducting circuit loop 2 between the reference voltage port 11 and the data input/output port 12 is changed from an open state to a closed state. Hence, the potential of the data input/output port 12 changes from high to low voltage level.

The opened or closed state of the switches 3 may be detected by the RFID tag 1. The RFID tag 1 generates a conductive code when the conducting circuit loop 12 is in the closed state, and the RFID tag 1 generates an open-circuit code when the conducting circuit loop 12 becomes an open state. A RFID reader 2 located within an effective distance from the RFID tag 1 is able to read the conductive code and the open-circuit code transmitted from the RFID tag 1 and thereby detects the status of the switch 3.

As shown in the first embodiment of the switch detection device using a RFID tag in FIG. 2, the switch detection device 100 comprises the detection 10 and an actuator comprising a lever 51, a rod 52 and a resilient member 53 accommodated in a housing 4. One end of the lever 51 is pivotally mounted to a side of the housing 4. An upper end of the rod 52 is protruded outward through the top end of the housing 4 and engaged with the lever 51. The switch 3 is arranged under a lower end of the rod 52. At the normal state, the switch 3 is not in contact with the conducting circuit loop 12, and hence the conducting circuit loop 2 is in an open state.

When a downward external force is applied to the right side of the lever 51, a pressing force leads to a downward displacement of the rod 52. At the same time, the switch 3 displaces vertically downward. Subsequently, the switch 3 is in contact with the conducting circuit loop 2. The conducting circuit loop 2 becomes closed state and a conductive code is generated at the RFID tag 1.

Once the external force to the lever 51 is removed, the switch 3 is disconnected. The conducting circuit loop 2 restores to the open state.

The resilient member 53 may comprise a spring, serving as a buffer in a security system to provide buffering effect to prevent the incautious touch that would cause the activation of the switch detection device. The data input/output port 12 may be arranged at the internal surface of the housing 4 or at the external surface of the housing 4. The data input/output port 12 is made of electrically conductive material which may be copper, aluminum, alloy or conducting glue.

Figure 3:
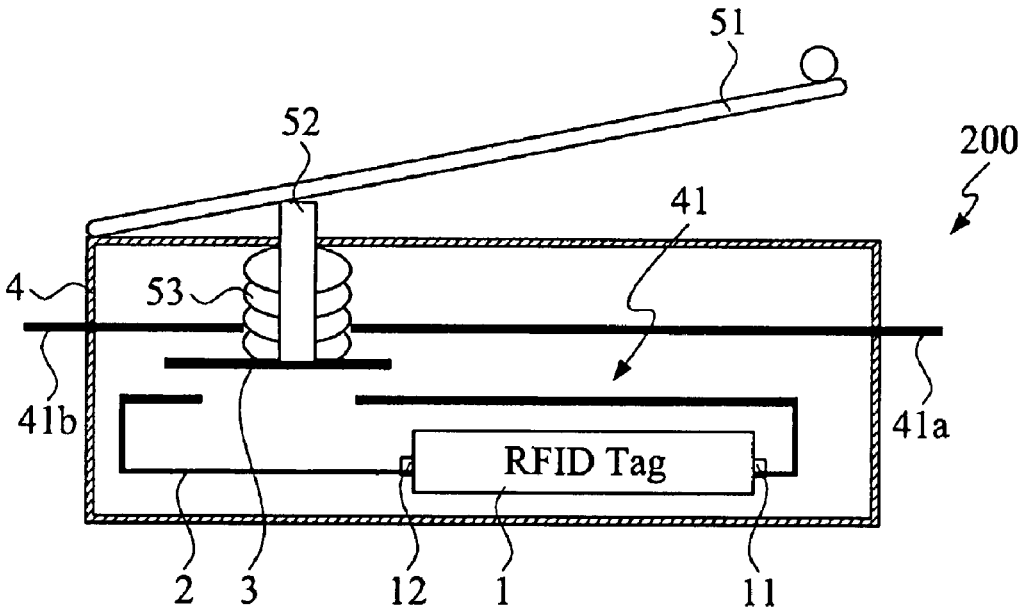
FIG. 3 is a schematic view of a second embodiment of the switch detection device constructed in accordance with the present invention.

FIG. 3 is a schematic view of a second embodiment of the switch detection device constructed in accordance with the present invention. The second embodiment is different from the first embodiment in that the switch detection device 200 further comprises a wired external switching loop 41 which includes two terminals 41*a*, 41*b* extended to the outside of the housing 4. The detection mechanism of the second embodiment is similar to that of the first embodiment, except that in the second embodiment, the state of the external switching loop 41 is also transmitted wirely.

At the normal condition, there is not external force at the lever 51 and the switching loop 41 is in closed state. When the lever 51 is pressed downward, the wired external switching loop 41 is changed to open state, and an open-circuit code is transmitted through the terminals 41*a*, 41*b*. On the other hand, the switch 3 is in contact with the conducting circuit loop 2 and the data input/output port 12, and the conducting circuit loop 2 is in closed state. Consequently, a conductive code is generated and transmitted through the RFID tag 1.

Figure 4:
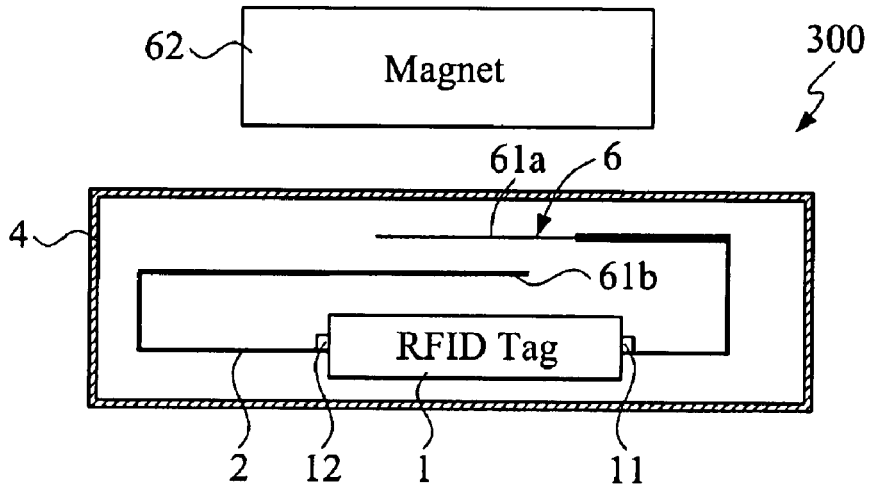
FIG. 4 is a schematic view of a third embodiment of the switch detection device using RFID tag constructed in accordance with the present invention.

FIG. 4 is a schematic view of a third embodiment of the switch detection device using RFID tag constructed in accordance with the present invention. In the third embodiment, the switch detection device 300 further comprises a reed switch 6. As seen, the switch detection device 300 comprises a RFID tag 1, a conducting circuit loop 2 and a reed switch 6. The RFID tag 1, the conducting circuit loop 2 and the reed switch 6 are contained in a housing 4. The reed switch 6 has a first contact 61*a* connected to a reference voltage port 11 and a second contact 61*b* connected to a data input/output port 12 of the RFID tag 1. The ON/OFF state of the reed switch 6 is controlled by a magnet 62. When the magnet 62 gets close to the switch detection device 300, the magnet 62 induces magnetism to the first contact 61*a* and the second contact 61*b*. Subsequently, the first contact 61*a* and the second contact 61*b* get in touch with each other and the conducting circuit loop 2 is closed. The closed state is detected by the RFID tag 1 and a conductive code is generated by the RFID tag 1. The conductive code is read by a RFID reader (not shown) located within an effective distance.

Figure 5:
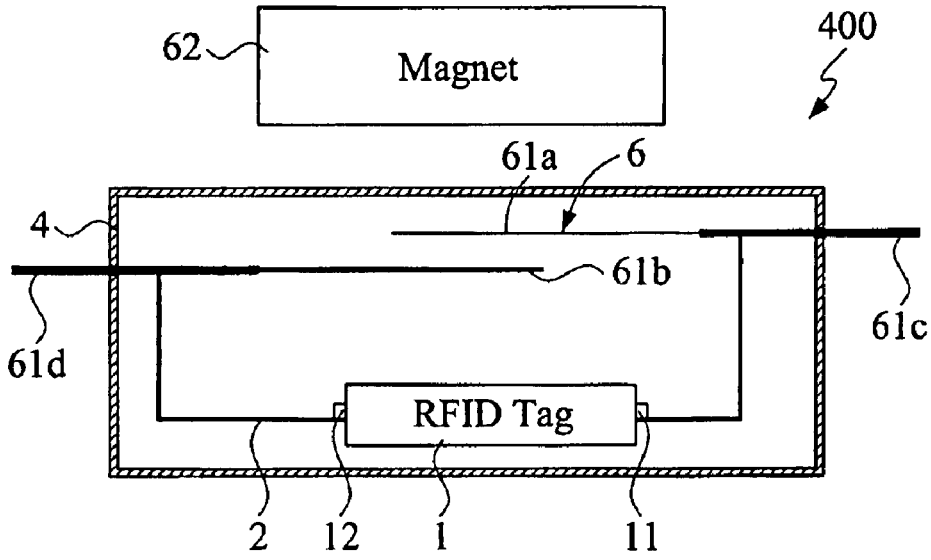
FIG. 5 a schematic view of a fourth embodiment of the switch detection device using RFID tag constructed in accordance with the present invention.

FIG. 5 is a schematic view of a fourth embodiment of the switch detection device using RFID tag constructed in accordance with the present invention. In the fourth embodiment, the switch detection device 400 comprises a wired external switching loop which includes a first terminal 61*c* and a second terminal 61*d* extended to the outside of the housing 4. The first terminal 61*c* is connected to the first contact 61*a* and the second terminal 61*d* is connected to the second contact 61*b*. When a magnet 62 gets close to the switch detection device 400, the first contact 61*a* is induced to contact the second contact 61*b*, and the detection circuit is closed. Then, a signal is transmitted through the first terminal 61*c* and a second terminal 61*d* wirely. Meanwhile, the RFID tag 1 generates and transmits a conductive code wirelessly.

Figure 6:
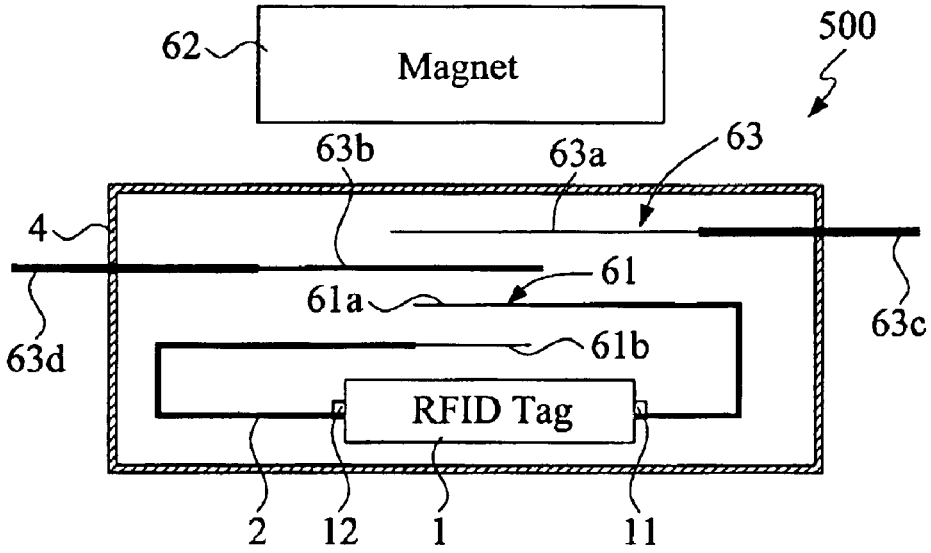
FIG. 6 is a schematic view of a fifth embodiment of the switch detection device using RFID tag constructed in accordance with the present invention.

FIG. 6 is a schematic view of a fifth embodiment of the switch detection device using RFID tag constructed in accordance with the present invention. The fifth embodiment is different from the fourth embodiment in that the fifth embodiment further comprises a second reed switch 63. The first reed switch 61 has a first contact 61*a* connected to a reference voltage port 11 and a second contact 61*b* connected to a data input/output port 12 of the RFID tag 1. The second reed switch 63 has a third contact 63*a* connected to a first terminal 63*c* and a fourth contact 63*b* connected to a second terminal 63*d*. The terminals 63*c*, 63*d* extend outward from the housing 4, forming a wired external switching loop.

When a magnet 62 gets close to the switch detection device 500, the first contact 61*a* is induced to contact the second contact 61*b* of the first reed switch 61, and the third contact 63*a* is induced to contact the fourth contact 63*b* of the second reed switch 63. Subsequently, a conductive code representing the closed state of the conducting circuit loop 2 is generated at the RFID tag 1, and a conductive code representing the closed state of the external switching loop 41 is transmitted.

In practice, multiple ways of encoding the conductive code and the open-circuit code may be adopted. For example, the conductive code (generated when the conducting circuit loop is in a closed state) may be a "0" in the binary code system, while the open-circuit (generated when the conducting circuit loop is in an open state) may be a "1". A plurality of circuit loops may be used to enhance the precision of detection. For example, four circuit loops may be arranged in a switch detection device. A signal of "0000" represents a perfectly closed state, while a signal of "1111" represents a completely open state. Each "1" represents a flaw of the switch. From the position of the "1", the opening of the switch is precisely identified.

In addition, the conducting circuit loop may be arranged at the internal surface or at the external surface of the housing. The RFID tag can store the product or substrate information and provide the information to a nearby RFID reader. Besides, the RFID tag provides the ON/OFF status of a switch which may be turned on by mechanical force or magnetic induction. The conducting circuit loop may be made of pliable metal materials such as aluminum, copper or transparent conducting glue.

The switch detection device of the present invention can be applied to any articles with a switch, like fan, table lamp, door bell, water faucet and so on. The switch may be turned on/off by pressing, twisting or switching. A buffering device, e.g. a spring, may be incorporated to the switch to form a buffered switch. The buffered switch may be applied in, e.g. water faucet.

Figure 7:
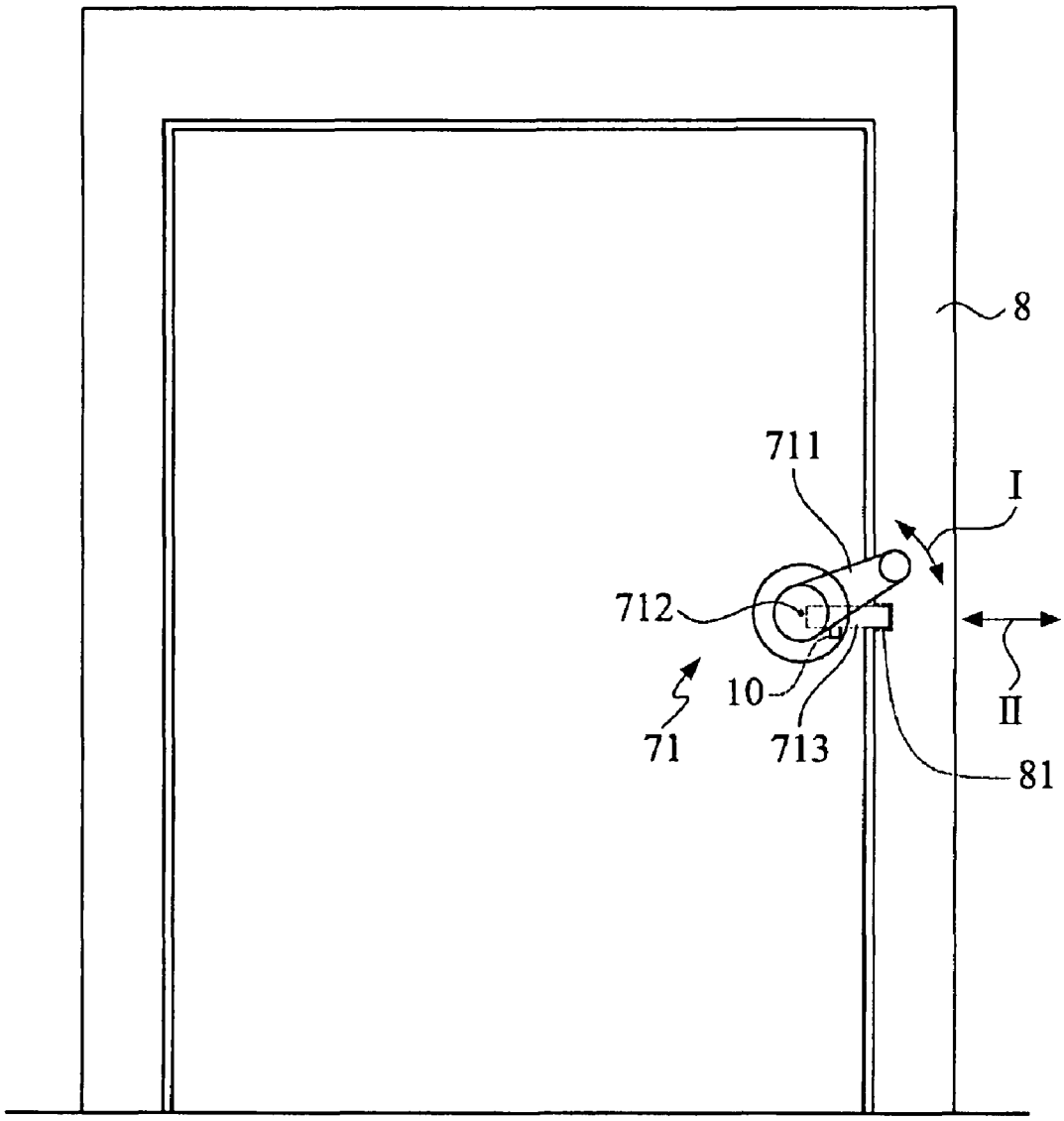
FIG. 7 shows a sixth embodiment of the switch detection device which is incorporated to a lever lock assembly.

FIG. 7 shows a sixth embodiment of the switch detection device of the present invention. The switch detection device is incorporated to a lever lock assembly 71 which includes a rotatable door handle 711, a central handle axis 712 and a movable lock pin 713. The door handle 711 is manually rotatable around the central handle axis 712. When the door handle 711 is turned by the user, the door handle 711 rotates along a rotation direction I. The rotation of the door handle 711 drives the lock pin 713 to move along a direction II to engage to or disengage from a hole 81 formed at a corresponding position at a door frame 8.

The lever lock assembly 71 incorporates a detection circuit 10 of FIG. 1. The detection circuit 10 is positioned at the displacement pathway of the lock pin 713. When the lock pin 713 moves along the direction II, the lock pin 713 drives the switch 3 of the detection circuit 10 to turn on or off and the RFID tag 1 generates a signal to a nearby RFID reader to indicate the locking or unlocking of the lever lock assembly 71. Through the switch detection device, the displacement distance of the lock pin 713 from a reference position e.g. a totally locking position is detected.

Figure 8:
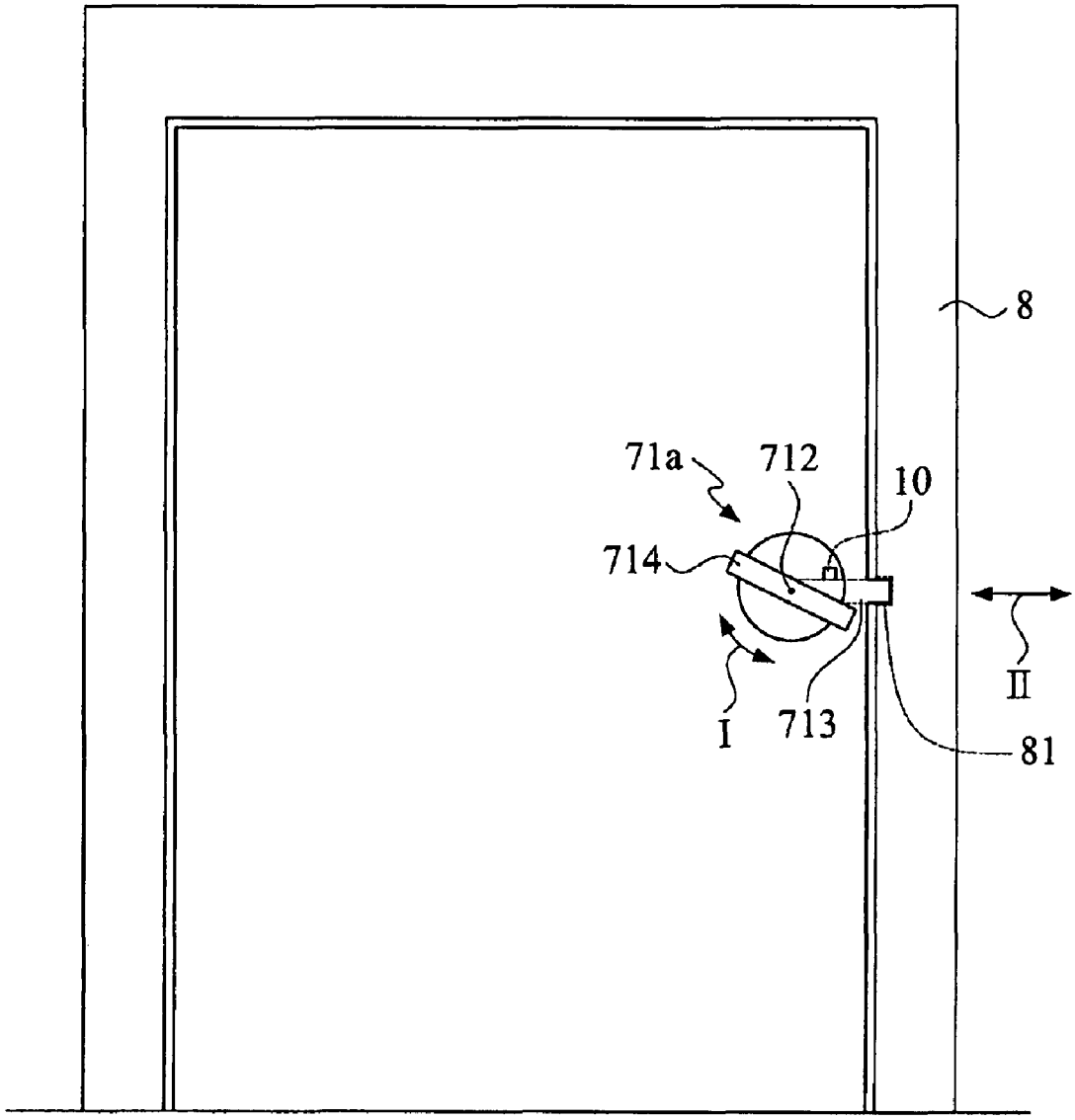
FIG. 8 shows a seventh embodiment of the switch detection device which is incorporated to a deadbolt lock.

FIG. 8 shows a seventh embodiment of the switch detection device of the present invention. The seventh embodiment is different from the sixth embodiment in that a deadbolt lock 71*a* is used instead of the lever lock assembly 71. The deadbolt lock 71*a* comprises a lock knob 712 and a lock pin 713. The lock knob 712 is rotatable around the central handle axis 712. The rotation of the lock knob 712 drives the lock pin 713 to move along a direction II to engage to or disengage from a hole 81 formed at a corresponding position at a door frame 8.

Similarly, a detection circuit 10 of FIG. 1 is mounted at the displacement pathway of the lock pin 713. When the lock pin 713 moves along the direction II, the lock pin 713 drives the switches of the detection circuit 10 to turn on or off and the RFID tag generates a signal to a nearby RFID reader to indicate the locking or unlocking of the lever lock assembly 71. Hence, the displacement distance of the lock pin 713 from a reference position e.g. a totally locking position is detected.

Figure 9:
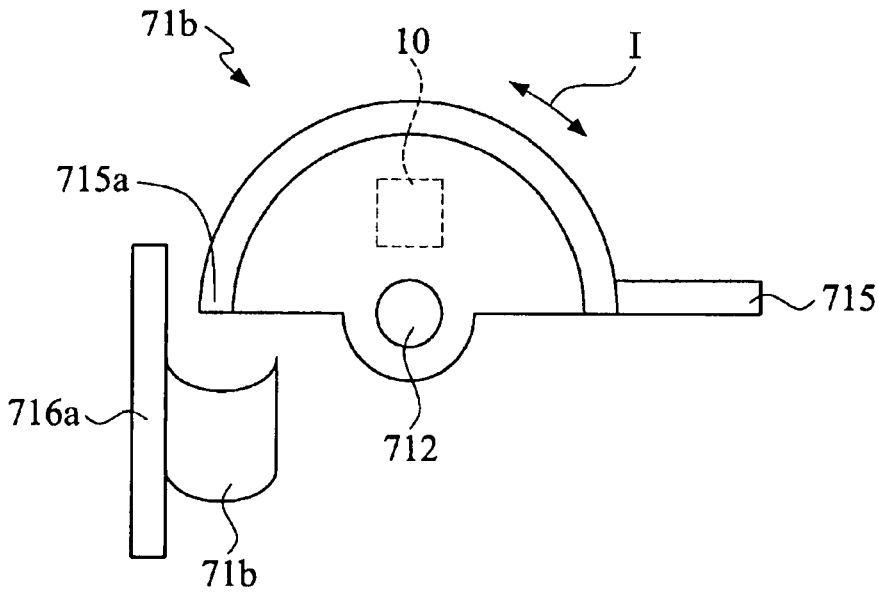
FIG. 9 shows an eighth embodiment of the switch detection device which is incorporated to a window sash lock.

FIG. 9 shows an eighth embodiment of the switch detection device of the present invention. The eighth embodiment is different from the sixth embodiment in that a window sash lock assembly 71*b* is used instead of the lever lock assembly 71. The window sash lock assembly 71*b* comprises a lever 715, a lock axis 712 and a stopper 716 installed at a window frame 716*a* or other selected object. The lever 715 is manually rotatable around the lock axis 712 in a rotation direction I. As shown in FIG. 9, the window sash lock assembly 71*b* is in an unlocked position. When a user turns the lever 715 in an anticlockwise direction, a lock end 715*a* opposite to the lever 715 hooks the stopper 716 of the window frame 716*a*, changing the window sash lock 71*b* to a locking position.

A detection circuit 10 of FIG. 1 is mounted in the window sash lock assembly 71*b*. When the lever 715 rotates along the direction I, the lever 715 drives the switches of the detection circuit 10 to turn on or off and the RFID tag generates a signal to a nearby RFID reader to indicate the locking or unlocking of the window sash lock assembly 71*b* and the degree of the rotation of the lever 715 from a reference position e.g. a totally locking position is also able to be detected.

Figure 10:
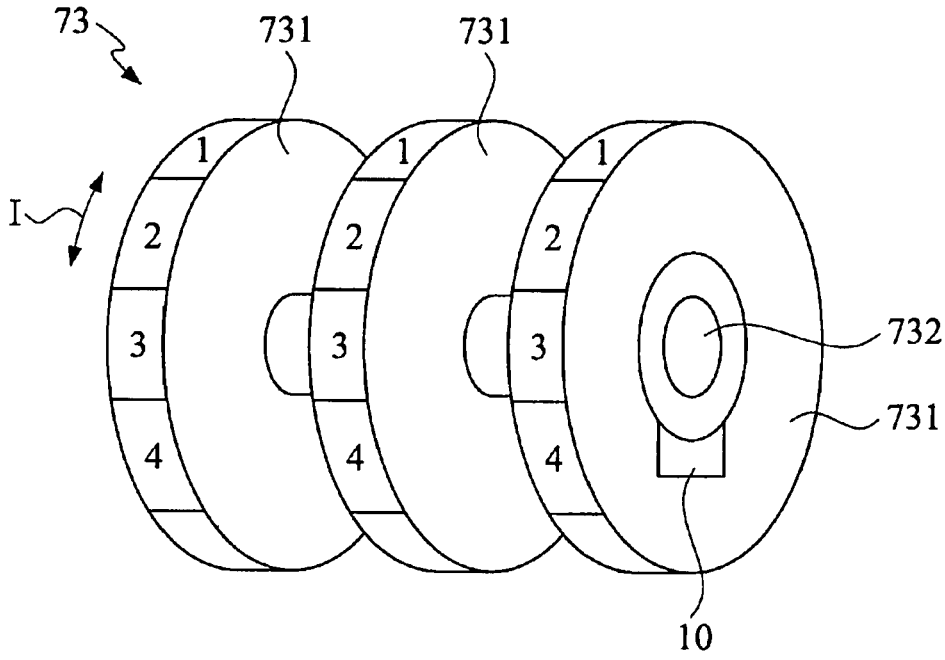
FIG. 10 shows a ninth embodiment of the switch detection device which is incorporated to a water flow meter.

FIG. 10 shows a ninth embodiment of the switch detection device of the present invention. The switch detection device is incorporated to a water flow meter or a gas flow meter. The water flow meter 73 generally comprises a recording mechanism that includes a number of parallel odometer wheels 731 arranged along a central axle 732. Each of the odometer wheels 731 has gradations around the perimeter to indicate water usage. A detection circuit 10 is mounted at the axle 732 for detecting the degrees of rotation of each of the odometer wheels 731. The rotation of the odometer wheel 731 indicates the measured value of the corresponding odometer wheel 731. From the rotations of the odometer wheels 731, the water usage is measured. A signal representing the measured data is transmitted by the RFID tag to a nearby RFID reader.

Figure 11:
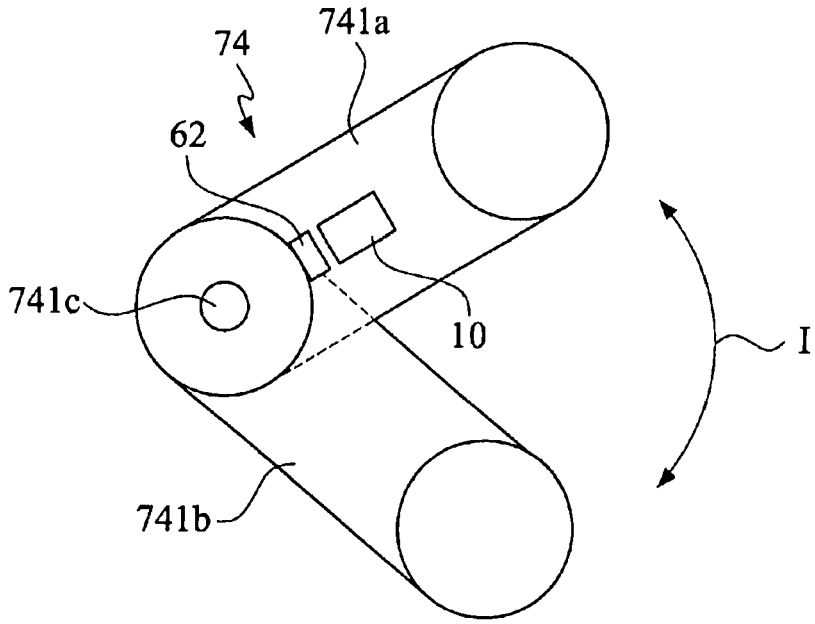
FIGS. 11 to 13 show a tenth embodiment of the switch detection device which is incorporated to a hinge.
Figure 12:
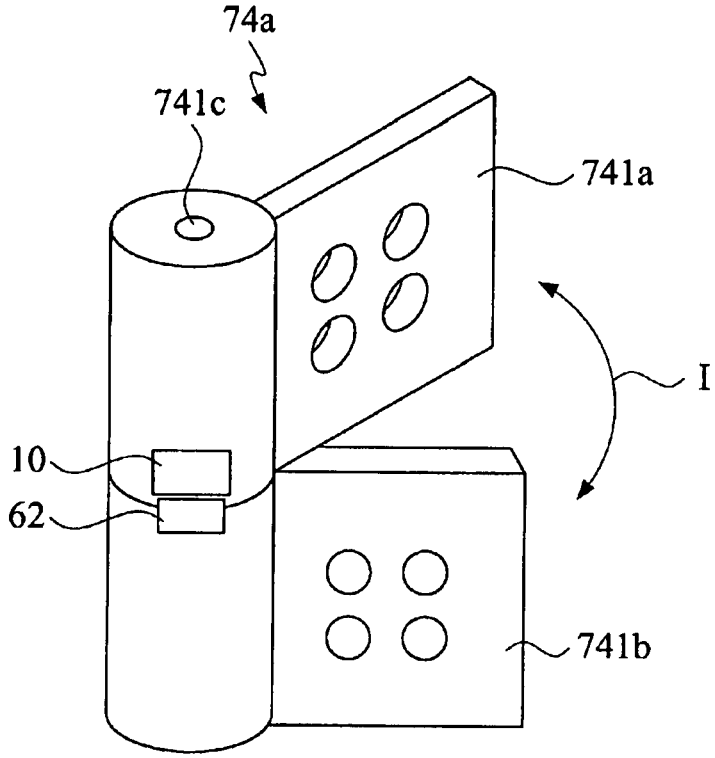
Figure 13:
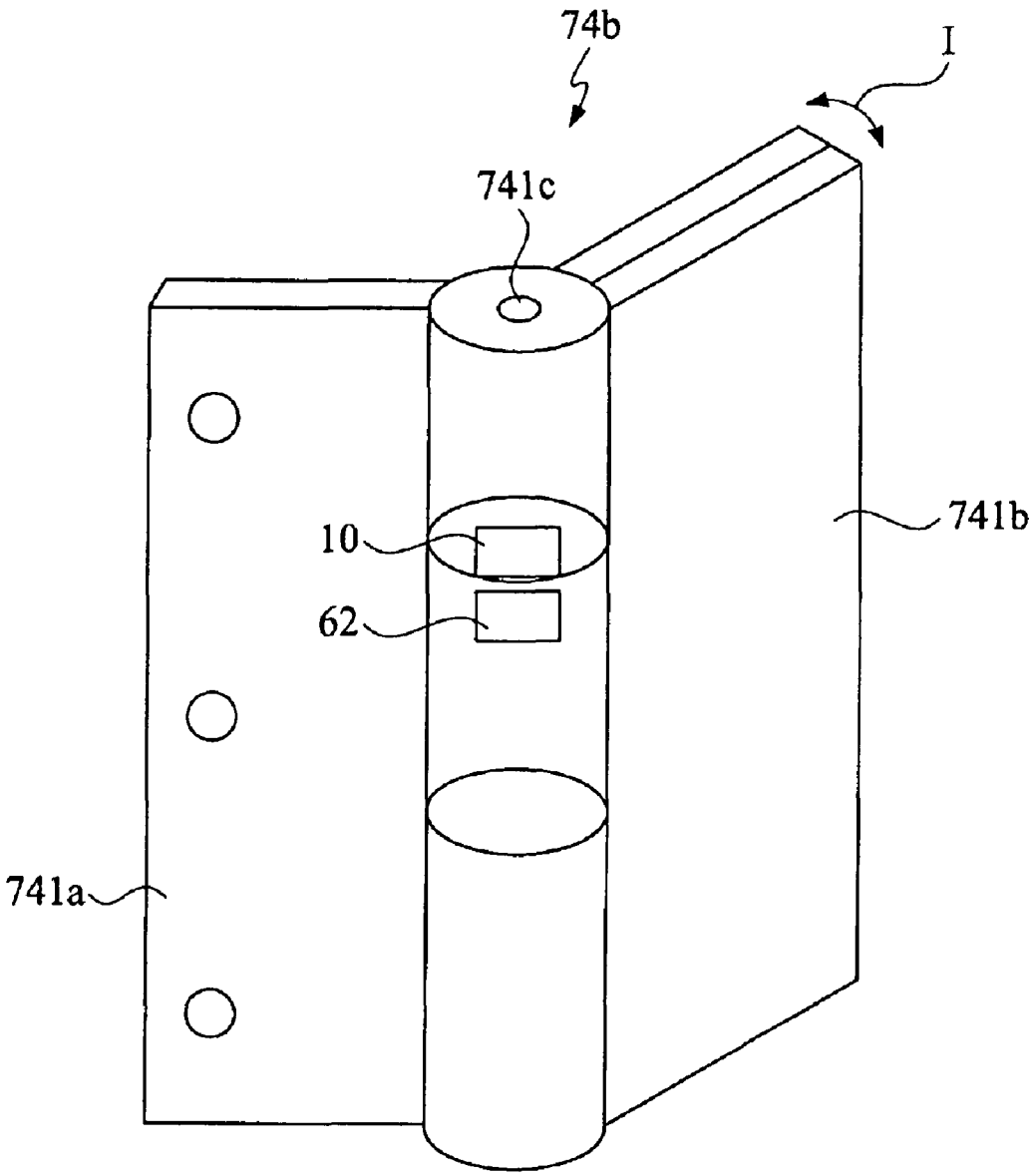

FIGS. 11 to 13 show various applications of a tenth embodiment of the switch detection device of the present invention. In the tenth embodiment, the switch detection device is incorporated to a hinge 74, 74*a*, 74*b* for fastening a door or a window. The hinge 74, 74*a*, 74*b* comprises a first and second hinge members 741*a*, 741*b* interconnected by a central axle 741*c* that allows relative rotation between the first and second hinge members 741*a*, 741*b*. Generally, the first hinge member 741*a* is fastened to a door frame or a window frame, and the second hinge member 741*b* is allowed to rotate around the axle 741*c* along a direction I.

A detection circuit 10 is mounted in the first hinge member 741*a* and a magnet 62 is mounted to the second hinge member 741*b*. The detection circuit 10 and the magnet 62 are arranged to be adjacent to each other when the first and second hinge members 741*a*, 741*b* are at a first position e.g. a closed position. When the second member 741*b* is turned, the magnet 62 is removed from the detection circuit 10, and the induction to the reed switches is weaken. Hence, the degree of opening of the hinge is detected and a signal is generated by the RFID tag of the switch detection device. The signal is transmitted to a RFID reader located within an effective distance.

Figure 14:
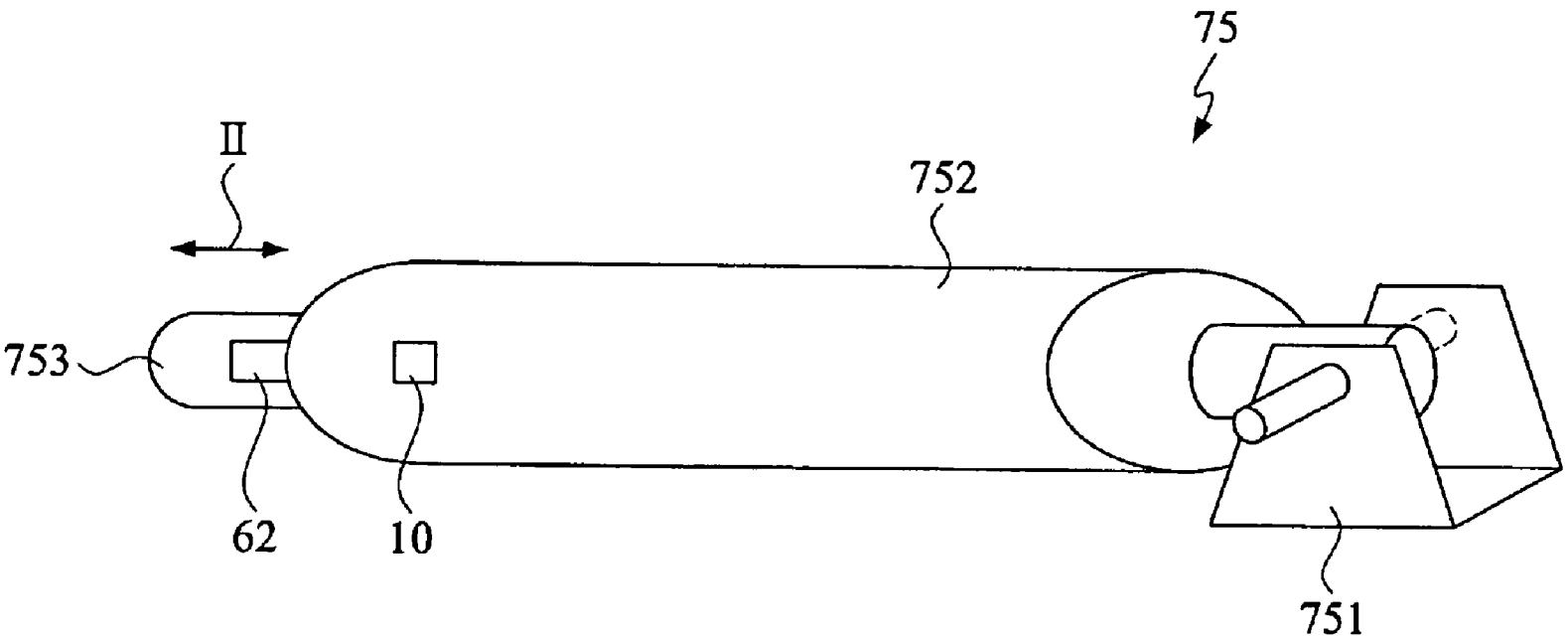
FIG. 14 shows an eleventh embodiment of the switch detection device which is incorporated to a pneumatic door closer.

FIG. 14 shows an eleventh embodiment of the switch detection device of the present invention. In the eleventh embodiment, the switch detection device is incorporated to a hydraulic door closer or a pneumatic door closer. The pneumatic door closer 75 comprises a bracket 751 for fixing to a wall, a tubular body 752 and a piston rod 753. The free open end of the piston rod 753 is fixed at a door (not shown). The detection circuit 10 is mounted to the tubular body 10 and a magnet 62 is mounted to the piston rod 753.

When a user pull open the door, the piston rod 753 is pulled out of the tubular body 752 in a direction II and the pneumatic door closer 75 is stretched to its full length. When the user releases the door, the pneumatic door closer 75 slowly shrinks in length. Accordingly, the relative position of the magnet 62 to the detection circuit 10 varies as the piston rod 753 moves. From the relative position of the magnet 62, the degree of opening of the door is detected. A signal is sent from the RFID tag to indicate the degree of opening of the door.

Figure 15B:
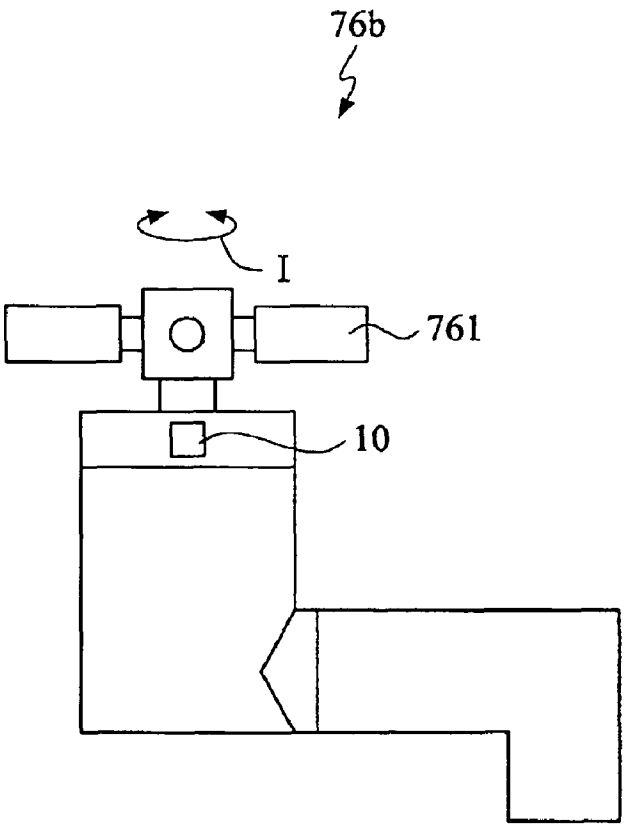
FIGS. 15*a* and 15*b* show a twelfth embodiment of the switch detection device which is incorporated to a water faucet.
Figure 15A:
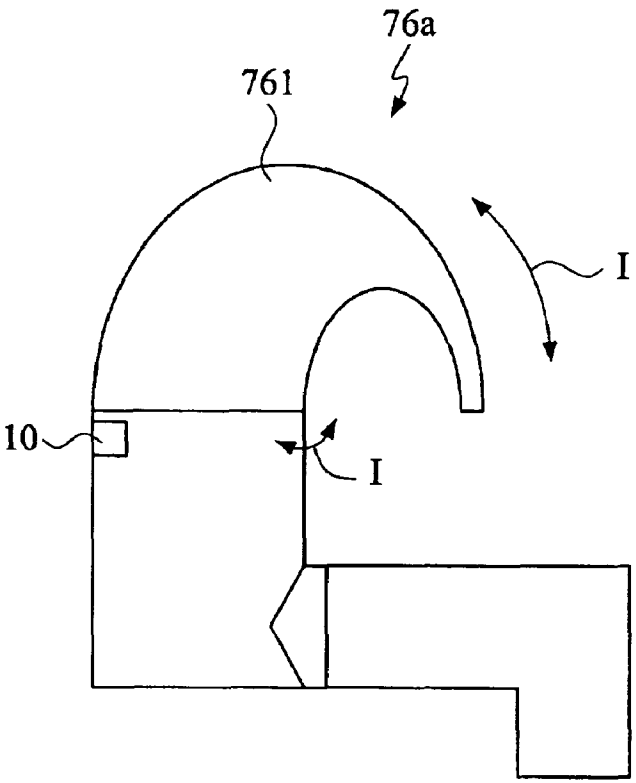

FIGS. 15*a* and 15*b* show a twelfth embodiment of the switch detection device of the present invention. In the twelfth embodiment, the switch detection device is incorporated to a water faucet 76*a*, 76*b*. The water faucet 76*a*, 76*b* comprises a faucet handle 761 that can be turned to rotate along a direction I for opening or closing. A detection circuit 10 is mounted below the faucet handle 761. When the faucet handle 761 rotates, the detection circuit 10 is able to detect the degree of opening of the water faucet 76*a*, 76*b*. A signal is sent from the RFID tag to indicate degree of opening of the water faucet 76*a*, 76*b*.

Figure 16:
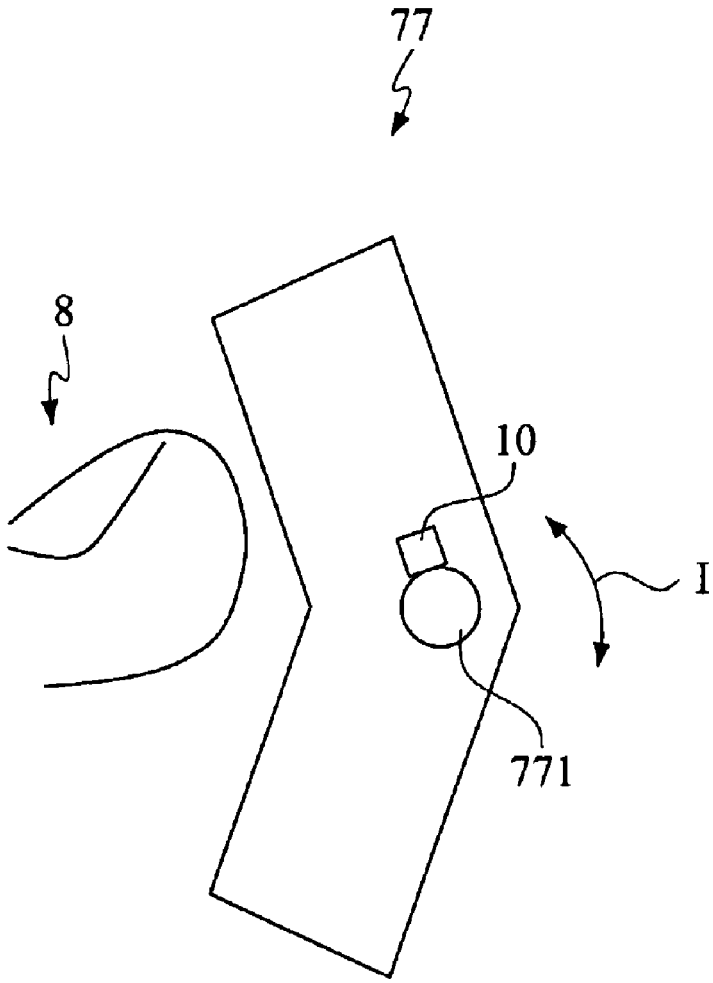
FIG. 16 shows a thirteenth embodiment of the switch detection device which is incorporated to a button.

FIG. 16 shows a thirteenth embodiment of the switch detection device of the present invention. In the thirteenth embodiment, the switch detection device is incorporated to a switch 77 which is rotatable around an axle 771 in a rotation direction I. A detection circuit 10 is arranged adjacent to the axle 771. When the user pushes the switch 77 by his finger 8, the switch 77 rotates, and the detection circuit 10 detects the rotation of the switch 77. A signal representing the status of the switch 77 is transmitted by the RFID tag to a nearby RFID reader.

Figure 17B:
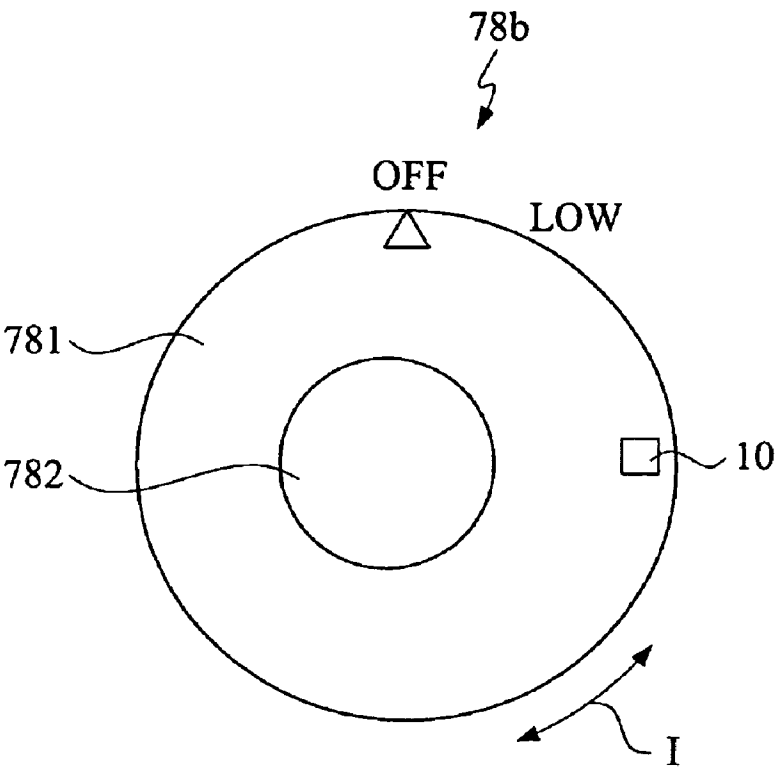
FIGS. 17*a* and 17*b* shows a fourteenth embodiment of the switch detection device which is incorporated to a control knob.
Figure 17A:
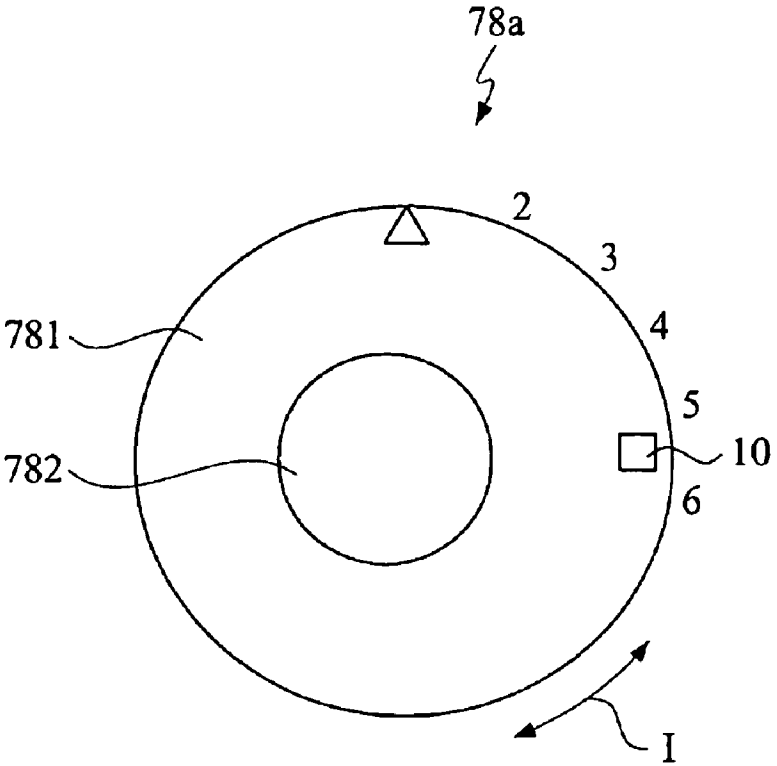

FIGS. 17*a* and 17*b* shows a fourteenth embodiment of the switch detection device of the present invention. In the fourteenth embodiment, the switch detection device is incorporated to a rotatable lock 78*a* or a rotatable switch 78*b*. The rotatable lock 78*a* comprises a rotatable circular member 781 and a knob 782. The rotatable circular member 781 can be manually rotated in a rotation direction I, which may be incorporated in a lock assembly. A detection circuit 10 is mounted to the rotatable circular member 781 for detecting the rotation of the rotatable circular member 781.

As shown in FIG. 17*b*, the rotatable switch 78*b* also comprises a rotatable circular member 781 and a knob 782. The rotatable circular member 781 can be manually rotated in a rotation direction I, which may be used to for example control a volume of a speaker of an audio device. A detection circuit 10 is mounted to the rotatable circular member 781 for detecting the rotation of the rotatable circular member 781.

While the invention has been described in connection with what is presently considered to the most practical and preferred embodiments, it is to be understood that the invention is not to be limited to the disclosed embodiments, but on the contrary, is intended to cover various modifications and equivalent arrangement included within the spirit and scope of the appended claims.

What is claimed is:

1. A switch detection device, comprising:

a RFID tag provided with a reference voltage port and at lease one data input/output port;

at least one conducting circuit loop provided with a first end and a second end respectively connected to the reference voltage port and the data input/output port of the RFID tag, having an open state and a closed state; and at least one switch electrically connected in the conducting circuit loop to actuate the conducting circuit loop in the open state or in the closed state, the switch including a portion displaceable between an open state position and a closed state position, the RFID tag, the conducting circuit loop and the switch being accommodated in a housing, the switch being driven by a lever combined with a resilient member and a rod, where the lever controls the switch through the rod;

wherein the open state or the closed state of the conducting circuit loop is transmitted through the conducting circuit loop to the data input/output port of the RFID tag, and thereby a signal representing the open state or the closed state of the conducting circuit loop is detected by the RFID tag.

2. The switch detection device as claimed in claim 1, wherein the conducting circuit loop comprises pliable metal material.

3. The switch detection device as claimed in claim 1, wherein the conducting circuit loop is made of an electrically conductive material selected from a group consisting one of copper, aluminum, alloy, and conducting glue.

4. The switch detection device as claimed in claim 1, wherein the switch comprises a reed switch having a first contact and a second contact, in which the first contact and the second contact are respectively connected to the reference voltage port and the data input/output port of the RFID tag.

5. The switch detection device as claimed in claim 4, wherein the first contact and the second contact are further extend outward from the housing respectively.

6. A switch detection device, comprising:

a RFID tag provided with a reference voltage port and at lease one data input/output port;

at least one conducting circuit loop provided with a first end and a second end respectively connected to the reference voltage port and the data input/output port of the RFID tag, having an open state and a closed state;

at least one switch electrically connected in the conducting circuit loop to actuate the conducting circuit loop in the open state or in the closed state, the switch including a portion displaceable between an open state position and a closed state position; and a wired external switching loop being actuated by the switch, the RFID tag, the conducting circuit loop, the switch and the wired external switching loop being accommodated in a housing, wired external switching loop having two terminals extended outward from the housing;

wherein the open state or the closed state of the conducting circuit loop is transmitted through the conducting circuit loop to the data input/output port of the RFID tag, and thereby a signal representing the open state or the closed state of the conducting circuit loop is detected by the RFID tag.

7. A switch detection device comprising:

a RFID tag provided with a reference voltage port and at lease one data input/output port;

at least one conducting circuit loop provided with a first end and a second end respectively connected to the reference voltage port and the data input/output port of the RFID tag, having an open state and a closed state; and at least one switch electrically connected in the conducting circuit loop to actuate the conducting circuit loop in the open state or in the closed state, having an open state and a closed state;

wherein the open state or the closed state of the conducting circuit loop is transmitted through the conducting circuit loop to the data input/output port of the RFID tag, and thereby a signal representing the open state or the closed state of the conducting circuit loop is detected by the RFID tag;

wherein a first reed switch comprises a first contact and a second contact respectively connected to the reference voltage port and the data input/output port of the RFID tag; and wherein a second reed switch comprises a third contact and a fourth contact respectively extended outward from the housing.

8. A switch detection device, comprising:

a turning operation mechanism;

a detection circuit incorporated to the turning operation mechanism for detecting a rotation operation of the turning operation mechanism, the detection circuit further comprising:

a RFID tag provided with a reference voltage port and at lease one data input/output port; and at least one switch electrically connected between the reference voltage port and the data input/output port of the RFID tag, the switch including a portion displaceable between an open state position and a closed state position;

wherein the open state or the closed state of the switch is detected by the RFID tag, and thereby a signal representing the open state or the closed state of the switch is detected by the RFID tag.

9. The switch detection device as claimed in claim 8, wherein the turning operation mechanism is a lever lock assembly which comprises a rotatable door handle, a central handle axis and a movable lock pin, the door handle being manually rotatable around the central handle axis and the door handle driving the lock pin to move along a direction, the detection circuit being arranged to detect the movement of the lock pin.

10. The switch detection device as claimed in claim 8, wherein the turning operation mechanism is a deadbolt lock assembly which comprises a rotatable lock knob, a central handle axis and a movable lock pin, the door handle being manually rotatable around the central handle axis and the lock knob driving the lock pin to move along a direction, the detection circuit being arranged to detect the movement of the lock pin.

11. The switch detection device as claimed in claim 8, wherein the turning operation mechanism is a window sash lock assembly which comprises a lever with a lock end, a lock axis and a stopper, the lever being rotatable around the lock axis in a rotation direction, the detection circuit being arranged to detect the rotation of the lever.

12. The switch detection device as claimed in claim 8, wherein the turning operation mechanism comprises at least one odometer wheel arranged along a central axle, the detection circuit being arranged to detect the rotation of the odometer wheel.

13. The switch detection device as claimed in claim 8, wherein the turning operation mechanism comprises a hinge provided with a first hinge member and a second hinge member interconnected by a central axle and allowing a relative rotation between the first hinge member and the second hinge member.

14. The switch detection device as claimed in claim 8, wherein the turning operation mechanism comprises a door closer provided with a bracket, a tubular body and a piston rod, a free end of the piston rod being movably extended from an open end of the tubular body, the detection circuit being mounted to the tubular body and a magnet being mounted to the piston rod, a relative position of the magnet to the detection circuit being detected by the RFID tag.

15. The switch detection device as claimed in claim 8, wherein the turning operation mechanism comprises a water faucet provided with a faucet handle, the detection circuit being arranged adjacent to the faucet handle to detect a rotation of the faucet handle.

16. The switch detection device as claimed in claim 8, wherein the turning operation mechanism comprises a switch which is rotatable around an axle, the detection circuit being arranged adjacent to the axle to detect a rotation of the switch.

17. The switch detection device as claimed in claim 8, wherein the turning operation mechanism comprises a rotatable lock provided with a rotatable circular member and a knob, the rotatable circular member being rotatable in a rotation direction, the detection circuit being arranged adjacent to the rotatable circular member to detect a rotation of the rotatable circular member.

18. The switch detection device as claimed in claim 8, wherein the turning operation mechanism comprises a rotatable switch provided with a rotatable circular member and a knob, the rotatable circular member being rotatable in a rotation direction, the detection circuit being arranged adjacent to the rotatable circular member to detect a rotation of the rotatable circular member.

* * * * *